US005255550A

United States Patent [19]

Dittlo

[11] Patent Number: 5,255,550

[45] Date of Patent: Oct. 26, 1993

[54] DEVICE FOR DRAWING SHEET MATERIALS IN PARTICULAR SHEET BLANKS

[75] Inventor: Michel Dittlo, Courbevoie, France

[73] Assignee: Isoform, Puteaux, France

[21] Appl. No.: 809,161

[22] Filed: Dec. 18, 1991

[30] Foreign Application Priority Data

Dec. 18, 1990 [FR] France ..... 90 15866

[51] Int. Cl.[5] ..... B21D 26/00

[52] U.S. Cl. ..... 72/57; 72/63; 72/465; 29/421.1

[58] Field of Search ..... 72/56, 57, 60, 63, 465; 29/421.1

[56] References Cited

U.S. PATENT DOCUMENTS

| | | | |
|---|---|---|---|
| 2,342,858 | 2/1944 | Hansen . | |
| 2,761,405 | 9/1956 | Moller . | |
| 2,796,253 | 6/1957 | Schulze et al. . | |
| 3,382,690 | 5/1968 | Achler et al. | 72/57 |
| 4,770,015 | 9/1988 | De Smet | 72/57 |
| 4,833,903 | 5/1909 | de Smet | 72/57 |
| 5,016,458 | 5/1991 | De Smet | 72/57 |
| 5,067,336 | 11/1991 | de Smet | 72/57 |
| 5,081,859 | 1/1992 | DeSmet | 72/57 |

FOREIGN PATENT DOCUMENTS

| | | |
|---|---|---|
| 376808 | 7/1990 | European Pat. Off. . |
| 2564339 | 11/1985 | France . |
| 2641215 | 7/1990 | France . |

*Primary Examiner*—David Jones

*Attorney, Agent, or Firm*—Cushman, Darby & Cushman

[57] ABSTRACT

A device is provided for drawing sheet materials, in particular, sheet blanks. The device includes a cushion of elastic material disposed in an enclosure, a die for forming the sheet blank, the die having a peripheral portion constituting an upper blank holder. The device also includes a lower blank holder for supporting and maintaining at least a portion of the sheet blank which is placed directly on the cushion of elastic material and cooperates with the upper blank holder for clamping the sheet blank in at least localized zones. The lower blank holder bears against a slidable element disposed around lateral faces of the cushion.

39 Claims, 6 Drawing Sheets

DEVICE FOR DRAWING SHEET MATERIALS IN PARTICULAR SHEET BLANKS

Figure 1:
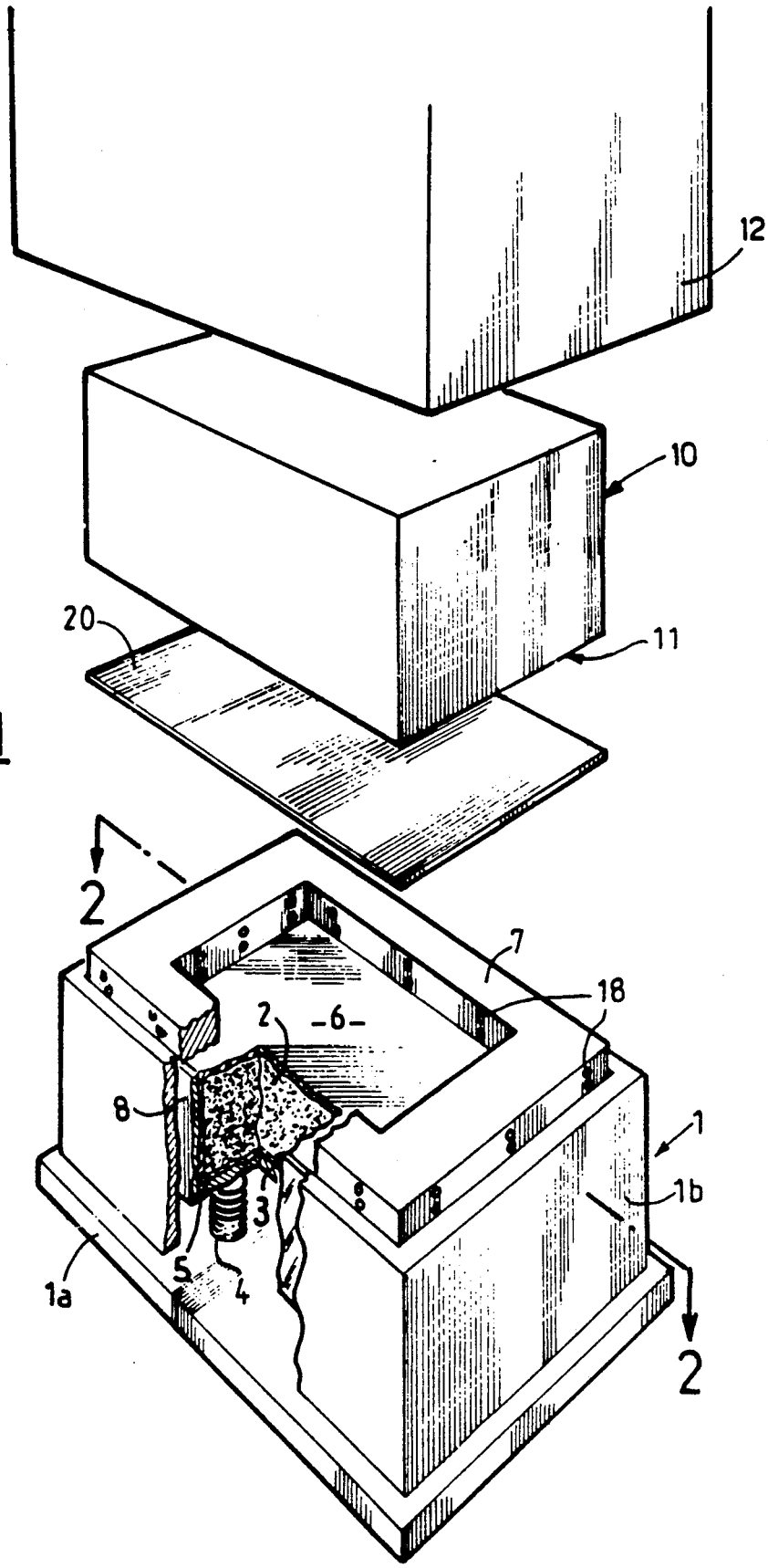

The present invention relates to a device for drawing sheet materials, in particular blanks of thin or extra-thin sheet.

It is known that the drawing of sheet blanks is usually carried out on presses which comprise means for forming the sheet blank constituted, on one hand, by a die whose peripheral portion constitutes a blank holder and, on the other hand, by another blank holder surrounding a punch.

This conventional device does not permit the drawing of thin or extra-thin sheets, since the rigidity of the die and the clamping of the sheet by the blank holder produce non-homogeneous deformations which bring about in certain zones stretchings liable to cause an excessive thinning of the sheet and in other zones contractions liable to cause a thickening of the sheet blank, which result in the formation of wrinkles.

Further, for steels having a high elastic limit, this conventional drawing method requires, for the purpose of avoiding the formation of wrinkles under the blank holder, the application on the sheet blank of a very high pressure that most press machines cannot provide.

There is also known from the document FR-A-2 564 339, a drawing method carried out on a punch formed by a cushion of an elastic material.

This method comprises placing the sheet to be drawn on the cushion of elastic material, applying by means of an outer slide a blank holder on the peripheral portion of the sheet blank to compress the periphery of the cushion and deform the central portion of said sheet blank thereby imparting thereto, at the end of a preforming step, a surface area substantially equal to the surface area of the finished part to be obtained, then applying by means of a center slide a punch on the central portion of the sheet blank to impart to the pressing its final shape.

This method permits the drawing of a sheet material, in particular a material having a low elongation, which may be in particular a sheet of metal, for example steel.

The cushion of elastic material is described as being formed by a substantially rectangular-sided mass based on a silicone elastomer having a low Shore hardness.

This method in which the sheet blank is placed directly on the cushion of elastic material, permits the drawing of parts having a substantially constant thickness and may be in particular used for thin or extra-thin sheets.

But this method does not permit effectively opposing the formation of wrinkles in the zones corresponding to a high contraction, in particular the angular zones.

Indeed, the drawing of parts of complex shapes produces in the angular zones in a high contraction whose tendency to form wrinkles can only be reduced by increasing the pressure exerted by the blank holder on the sheet blank.

Now, with the method disclosed in the document FR-A-2 564 339, the sheet is insufficiently maintained or held in the zone under the blank holder, i.e. between the blank holder and the cushion of elastic material which does not have in itself sufficient rigidity.

Another drawback of this known method resides in the surface deterioration of the material of the cushion in the region of the zone under the blank holder, which is prejudicial to a mass production of the pressings.

To overcome these drawbacks, there is known from the document FR-A-2 641 215 a device for drawing sheet materials, in particular sheet blanks, which comprises a cushion of elastic material disposed in a retaining container, means for preforming the sheet blank constituted by an outer slide carrying an upper blank holder, and means for finally forming said sheet blank constituted by a center slide acting on a punch.

This device further comprises a lower blank holder constituted by means for supporting and maintaining at least a portion of the sheet blank, placed directly on the cushion and cooperating with the upper blank holder for clamping the sheet blank at least in localized zones of the blank.

To draw the sheet blank, the lower blank holder penetrates into the retaining container and by reaction compresses the cushion of elastic material.

In this way, under the effect of this peripheral compression action, the cushion acts on the central zone of the sheet blank and results in the forming of the latter.

However, this device has drawbacks.

Indeed, the angular zones constituted in particular by the corners of the lower blank holder, produce upon each sliding of said blank holder a pinching and a lamination of the elastic material of the cushion with the walls of the retaining container, so that, after a certain number of sheet blank forming operations, the cushion deteriorates and this is prejudicial to the mass production of the pressings.

This pinching and lamination phenomenon is still further accentuated when the device comprises means for regulating the displacement of the bottom of the retaining container for absorbing the excess volume of the cushion relative to that determined by the surface area of the finished part to be obtained, as explained in the document FR-A-2 641 217.

Indeed, the successive displacements of the bottom of the retaining container result in a pinching and a lamination of the elastic material of the cushion with the lateral walls of the container.

Furthermore, there is produced at the moment of the return to the state of equilibrium of the cushion of elastic material, i.e. at the moment of the rising of the lower blank holder, a suction effect of the cushion on the formed part which might cause the collapse of the latter, in particular in the case of parts of large size.

The return of the cushion to its initial state occurs in the direction from the center toward the periphery, which increases the suction effect.

Further, the suction effect increases with increase in the ratio of the surface area of the cushion to the surface area of the part.

Lastly, the device disclosed in the document FR-A-2 641 215 has another drawback.

When the volume of the deformation of the sheet blank is large, the cushion is subjected to large deformations and high pressures, so that the radii of the deformation of the sheet blank are limited and are too large for certain applications.

An object of the present invention is to overcome these drawbacks and to improve the effectiveness and the life of the cushion of elastic material for obtaining drawn parts in mass production, such as automobile parts whose central portions are practically never shapes of revolution but have non-developable complex shapes of variable dimensions for a given tool framework comprising in particular a container having a fixed volume.

The invention therefore provides a device for drawing sheet materials, in particular sheet blanks, comprising a cushion of an elastic material disposed in a enclosure, means for forming the sheet blank comprising a die whose peripheral portion forms an upper blank holder, and a lower blank holder constituting means for supporting and maintaining at least a portion of the sheet blank, placed directly on the cushion of elastic material and cooperative with said upper blanc holder for clamping at least localized zones of said sheet blank, characterized in that the lower blank holder bears against a slidable element disposed around lateral faces of the cushion of elastic material.

According to other features of the invention:

the slidable element is formed by a peripheral sleeve disposed between the lateral walls of the enclosure and the lateral faces of the cushion, said peripheral sleeve and said lower blank holder being interconnected and sliding in said enclosure, modulable wall elements are interposed between the lateral walls of the enclosure and the peripheral sleeve, the peripheral sleeve and the lower blank holder are subjected to a return force by at least one elastic means, formed on the periphery of the lower blank holder is at least one space for the passage of air between the lateral walls of the enclosure and said lower blank holder, the slidable element is formed by lateral walls of the enclosure, said lateral walls being cooperative with at least one means for regulating the displacement of said walls and said lower blank holder, the lateral walls and the blank holder are interconnected, the lateral walls and the blank holder constitute a single unit comprising a lower peripheral ring bearing against a means for regulating the displacement and an upper plate forming said lower blank holder and supporting the sheet blank, the lateral walls of the enclosure or of the part are covered with an antifriction material formed by at least one sheet of plastics material or rubber, the lower blank holder comprises at least one air inlet duct between the sheet blank and the cushion, said air duct is connected to a supply of air under pressure, the lower blank holder is formed by at least two superimposed machined plates defining therebetween said air inlet duct, one of the plates of the lower blank holder is composed of an incompressible elastic material, the plate of the lower blank holder in contact with the sheet blank comprises grooves on its inner vertical face, the plate of the lower blank holder in contact with the sheet blank is constituted by an assembly of machinable planks, the means for regulating the displacement is formed by a system of springs, the cushion of elastic material comprises on its upper face and contained within the opening of the lower blank holder, an elastic element for forming the sheet blank the Shore hardness of which is higher than the Shore hardness of the cushion, the elastic forming element is located in at least an angular zone of the cushion, the elastic forming element is constituted by at least two layers of different thickness and hardness, the elastic forming element is composed of different pieces of different hardness, the elastic forming element comprises, on its face in contact with the cushion, a lip for the rounding of said cushion, the elastic forming element is interchangeable, the cushion comprises, on its upper face, an interchangeable working sheet of an elastic material, the working sheet is connected to the lower blank holder, the working sheet is formed by at least two superimposed layers, the layers of the working sheet are locally interconnected, at least one of the layers of the working sheet is formed by an elastic textile material, at least one of the layers of the working sheet comprises substantially parallel slots, the elastic forming element comprises means for connecting it to the cushion in a localized zone of the upper face of said cushion, the elastic forming element comprises means for connecting it to the working sheet in a localized zone of the upper face of said working sheet, the connecting means are formed by at least one nail having a flat head, the connecting means are formed by at least one rivet having two flat heads, the cushion comprises on its lower face in contact with the bottom of the enclosure, an incompressible elastic sole having a Shore hardness higher than the Shore hardness of said cushion, the elastic sole is in the shape of a ring.

Figure 2:
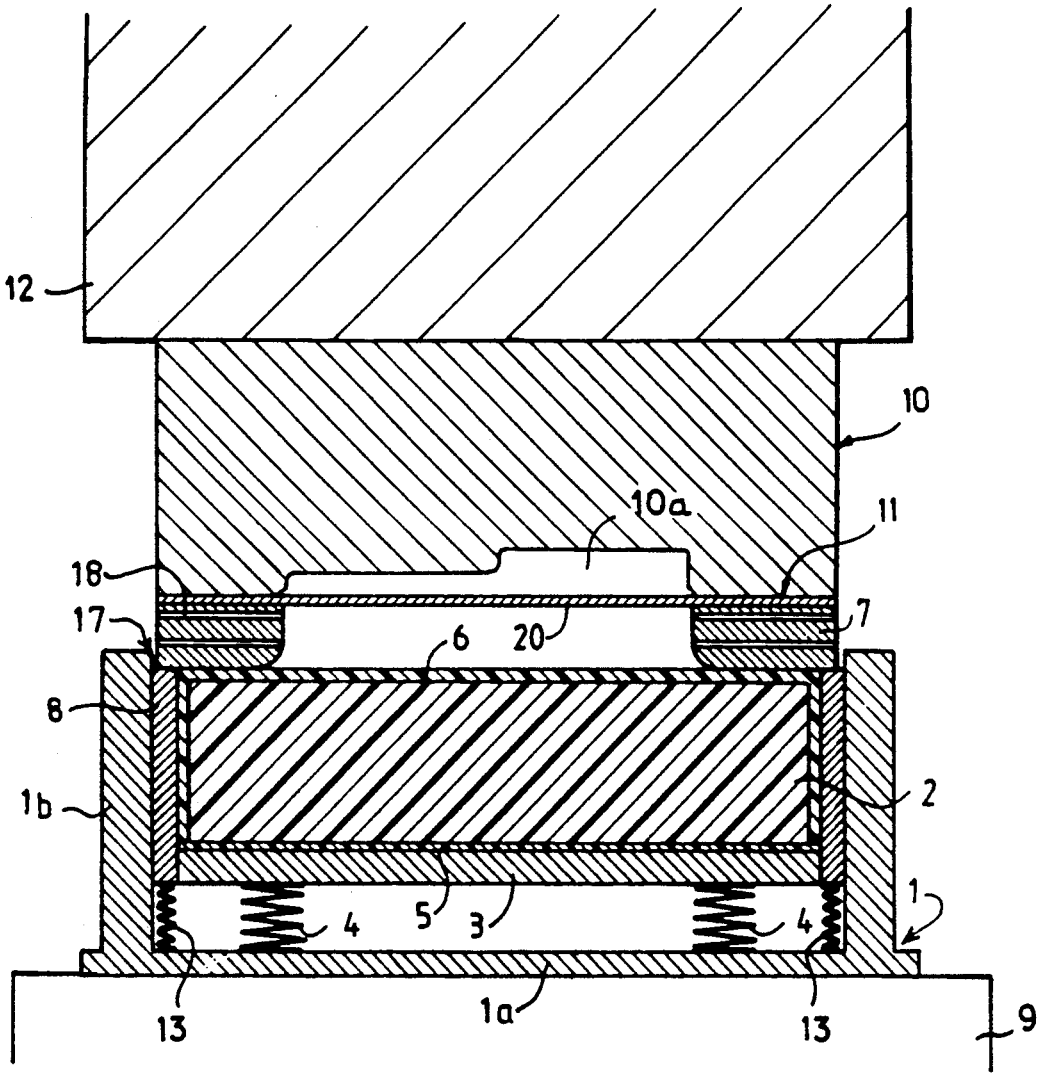
Figure 3:
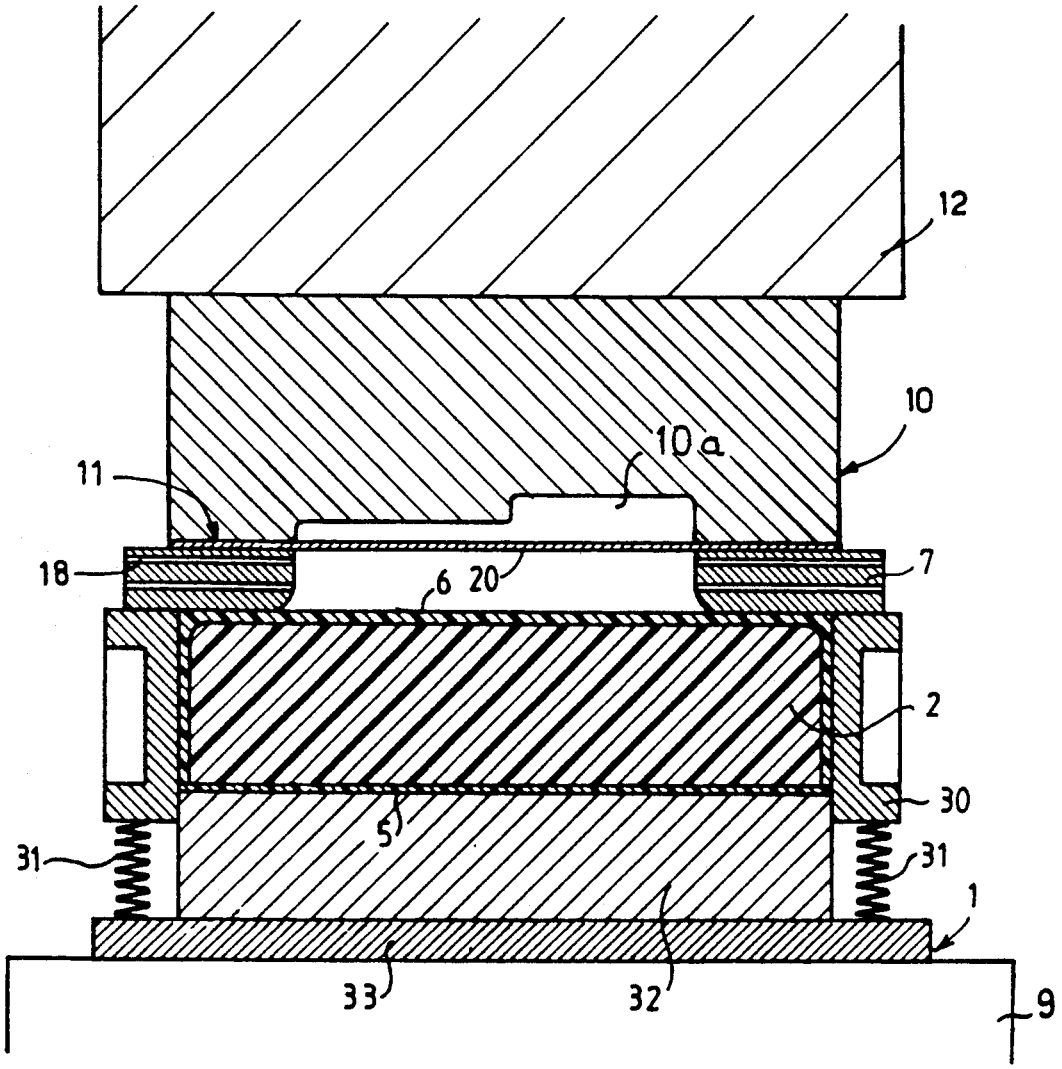
Figure 4:
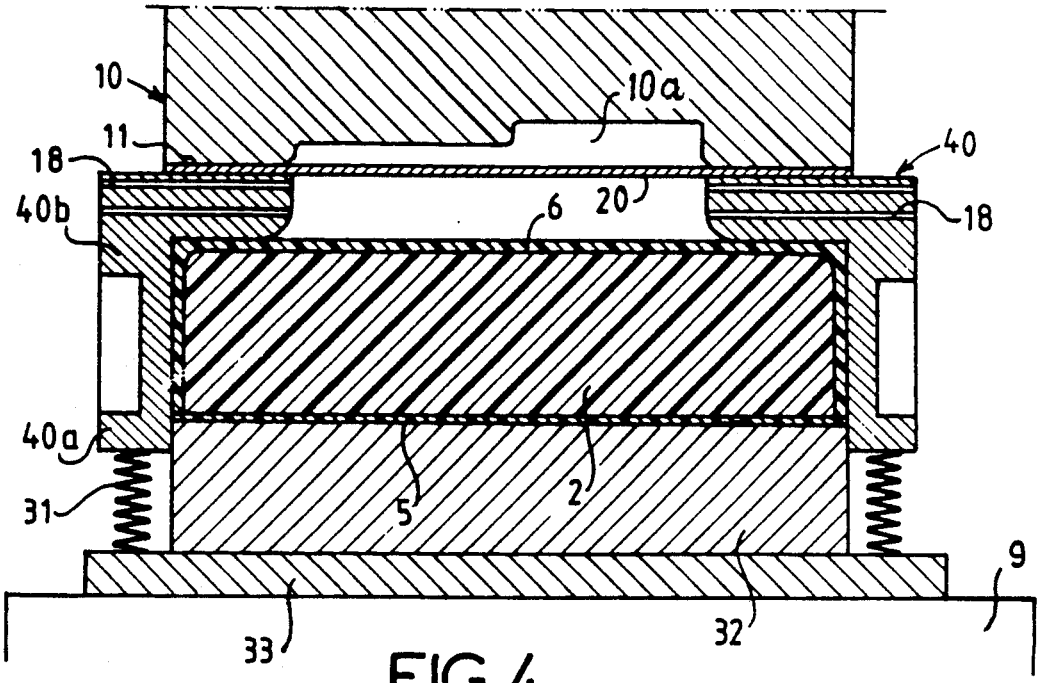
Figure 5:
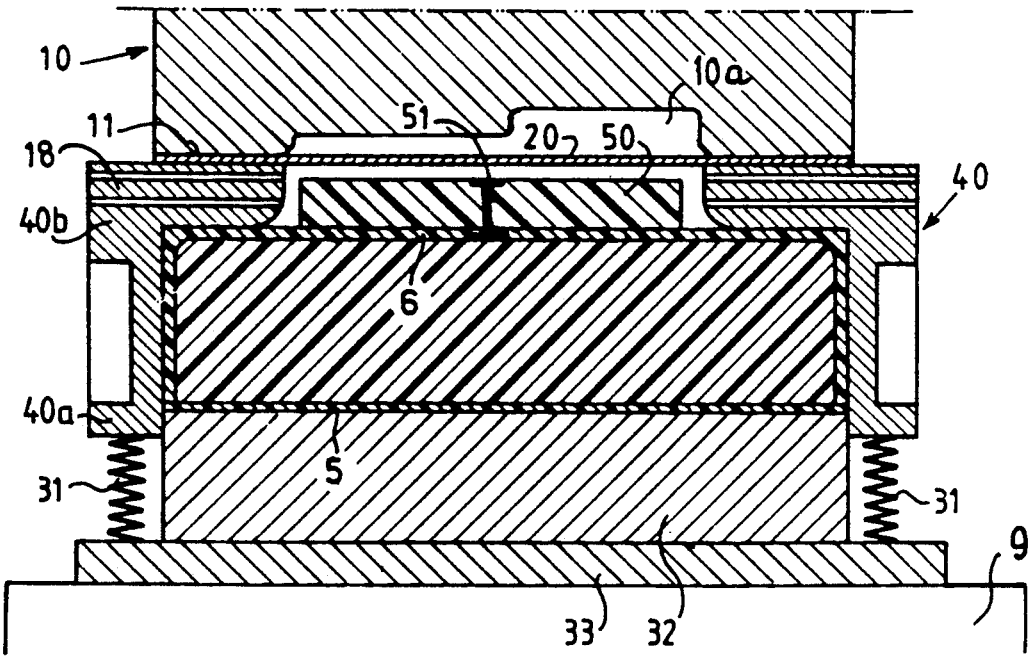
Figure 6:
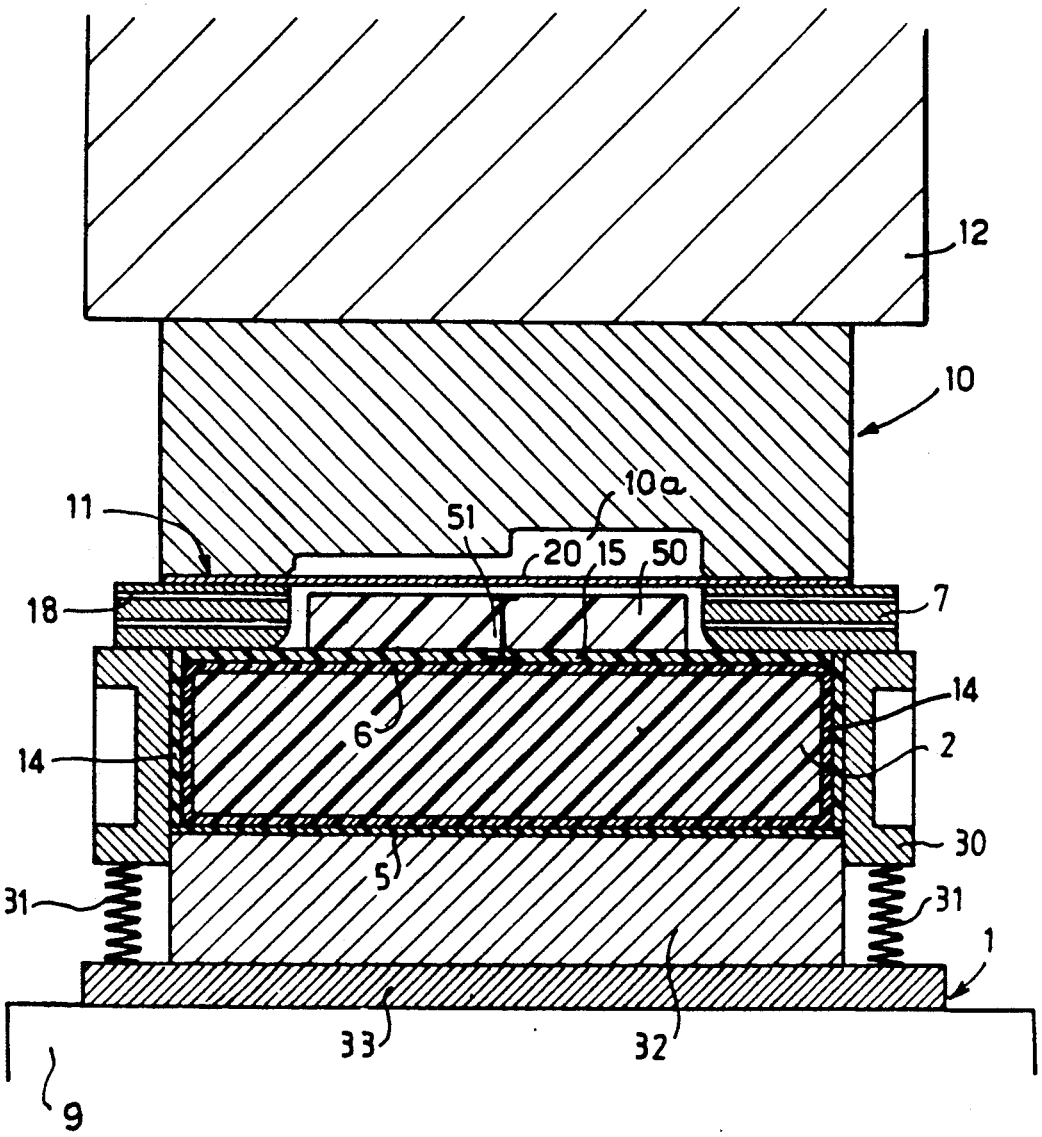
Figure 7:
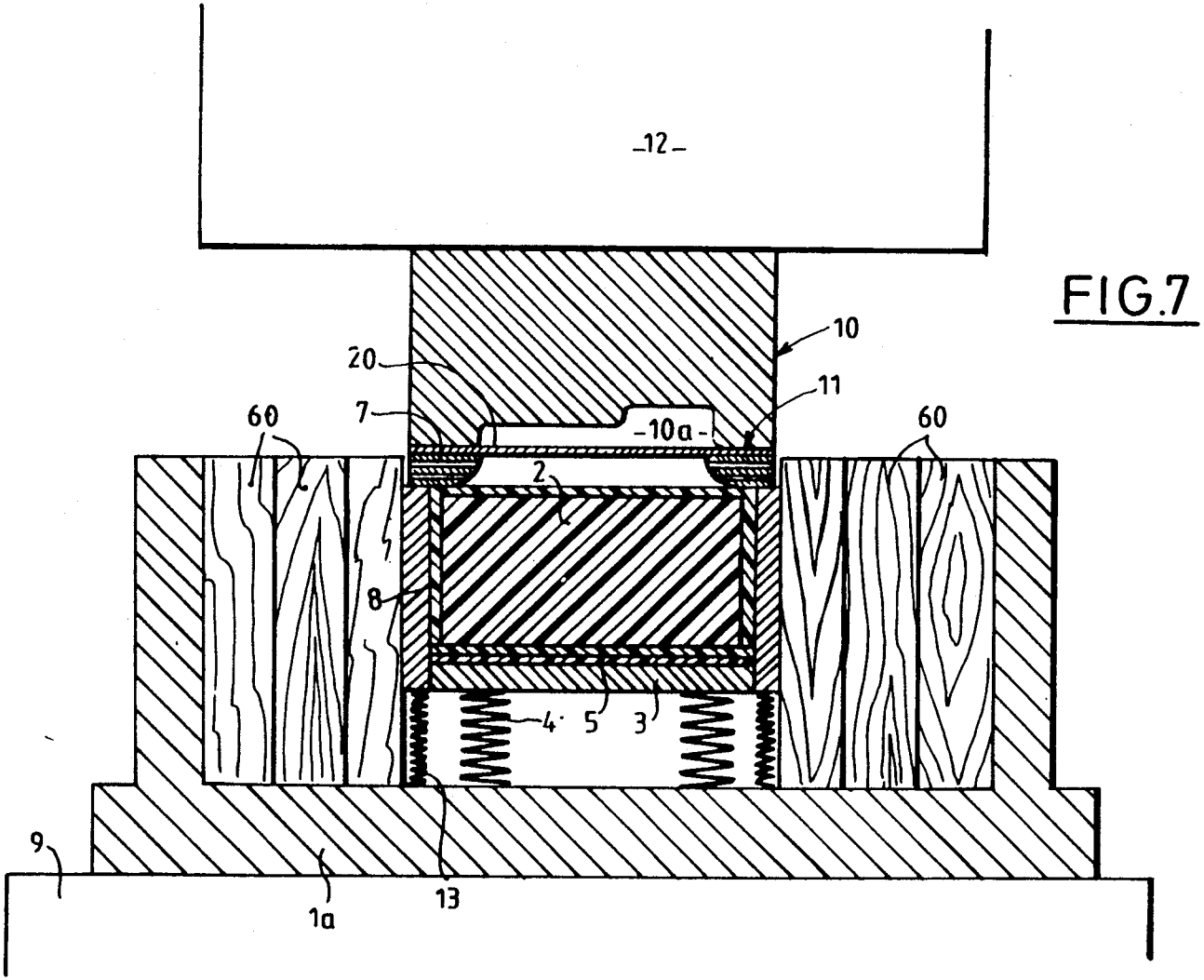

A better understanding of the invention will be had from the following description given solely by way of example with reference to the accompanying drawings, in which:

FIG. 1 is an exploded perspective view of the different elements constituting the drawing device according to the invention, FIG. 2 is a sectional view taken on line 2—2 of FIG. 1, FIG. 3 is a sectional view of a first alternative embodiment of the drawing device, FIG. 4 is a sectional view of a second alternative embodiment of the drawing device, FIG. 5 is a sectional view of a third alternative embodiment of the drawing device, FIG. 6 is a sectional view of a fourth alternative embodiment of the drawing device, FIG. 7 is a sectional view of a fifth alternative embodiment of the drawing device The drawing device shown in FIGS. 1 and 2 comprises a enclosure 1 defining a housing for a cushion 2 of an elastic material.

The enclosure 1 rests on a press table 9 and the cushion 2 rests on a support plate 3.

Means may be interposed between the support plate 3 and the bottom of the enclosure 1 for regulating the pressure created in the cushion 2 when forming the part.

These means may be formed for example by springs 4 or a jack.

Further, the lower face of the cushion 2 in contact with the support plate 3 is provided with an incompressible elastic sole 5 having a Shore hardness higher than the Shore hardness of the cushion. This elastic sole may have the shape of a ring.

The upper face and the lateral faces of the cushion 2 are covered with a skin 6 of an elastic material which may be if desired an antifriction material.

Disposed on the upper face of the cushion 2 is a lower peripheral blank holder 7 constituted by a frame, for example having a closed contour and substantially matching the shape of the inner housing defined by the enclosure 1 so as to be capable of penetrating said housing when forming the part.

Further, the lower blank holder 7 also bears against an element which is slidable, for example vertically, formed by a peripheral sleeve 8 disposed between the lateral faces of the cushion 2 and the lateral walls 1*b* of the enclosure 1.

The lower blank holder 7 and the sleeve 8 are interconnected by suitable means (not shown) and the assembly formed by the blank holder 7 and the sleeve 8 and by the cushion 2 and the support plate 3, is slidable in the inner housing defined by the enclosure 1.

The lower blank holder 7 and the sleeve 8 are subjected to a return force by at least one elastic means 13 constituted for example by springs interposed between the sleeve 8 and the bottom 1*a* of the enclosure 1.

Above the enclosure 1, the drawing device comprises a die 10 on which acts a slide 12 of a press.

The lower part 11 of the die 10 constitutes an upper peripheral blank holder.

The lower face of the die 10 includes a cavity 10*a* (FIG. 2) corresponding to the profile of the finished part to be obtained.

The lower blank holder 7 and the upper blank holder 11 have outside dimensions less than the contour of the housing defined by the enclosure 1 so as to leave at least a gap 17 for the passage of air existing between the sheet blank 20, placed on the lower blank holder, and the cushion 2 to the exterior through at least one small duct 18 provided in the lower blank holder 7.

The sheet blank 20 is drawn in the following manner.

First of all, the sheet blank 20 is placed on the lower blank holder 7, then the die 10 and the slide 12 gradually descend.

The upper blank holder 11 comes into contact with the sheet blank 20 whose peripheral portion is gradually clamped between the upper blank holder 11 and the lower blank holder 7.

The gradual descent of the slide 12 and the die 10 drives down the assembly: upper blank holder 11, lower blank holder 7 and the peripheral sleeve 8, and simultaneously causes the compression of the cushion 2 by reaction.

Under the effect of this peripheral compression, the cushion 2 acts by a flowing effect on the central zone of the sheet blank 2 and causes the forming of the blank.

In the course of the forming, the springs 4 regulate the displacement of the support plate 3 and consequently regulate the pressure created in the cushion 2 when forming the part.

Further, the sliding of the peripheral sleeve 8 simultaneously with the lower blank holder 7 avoids a pinching and lamination of the cushion 2.

The sole 5 also avoids the lamination of this cushion 2 in its lower part.

The springs 13 regulate the displacement of the lower blank holder 7 and the sleeve 8 brought about by the action of the slide 12.

The step for releasing the finished part occurs upon the simultaneous rising of the slide 12 and die 10.

In this releasing step, the removal of the cushion 2 from the formed part occurs from the periphery toward the center, since the air enters between the part and the upper face of the cushion through the gap 17 and the ducts 18 so that suction effects are avoided.

Preferably, the ducts 18 are connected to supplies of air under pressure to reduce the suction effect and permit a production rate of at least twenty strokes per minute, by ensuring an air flow of at least twice the volume of the part in each second.

The supply of air is cut off as soon as the cushion 2 returns to its position of equilibrium. This air supply is preferably located in the region of the shallowest depth of the drawn part.

In an alternative embodiment shown in FIG. 3, the vertically slidable element disposed around lateral faces of the cushion 2 is constituted directly by the lateral walls 30 of the case 1 on which the lower blank holder 7 bears.

The lateral walls 30 cooperate with a means 31 for regulating the displacement of these walls 30 and the lower blank holder 7.

This regulating means 31 is formed for example by a system of springs or a jack.

The cushion 3 bears, through the sole 5, on a support plate 32 which bears against a bolster 33 also acting as a support for the means 31 regulating the displacement of the walls 30 and the lower blank holder 7.

This lower blank holder 7 further comprises ducts 18 for the inlet of air between the sheet blank 20 and the cushion 2 and is connected to the walls 30 by suitable means (not shown).

The support plate 32 also guides the walls 30 when the latter slide downwardly.

The other elements of the device are identical to the preceding embodiment and the part is drawn in the same way.

In an alternative embodiment illustrated in FIG. 4, the lateral walls and the lower blank holder constitute a single unit 40 comprising a lower peripheral ring 40*a* bearing against the means 31 regulating the displacement and an upper plate 40*b* forming the lower blank holder and supporting the sheet blank 20.

The upper plate 40*b* also includes ducts 18 for the entry of air between the sheet blank 20 and the cushion 2.

The other elements of the device are identical and the forming of the part is achieved in the same way.

In another alternative embodiment illustrated in FIG. 5, the cushion 2 includes on its upper face and within the lower blank holder an elastic element 50 for forming the sheet blank 20, the Shore hardness of this element 50 being higher than the Shore hardness of the cushion 2.

The elastic forming element 50 may comprise at least two layers of different thickness and hardness.

Further, the elastic forming element 50 may also be interchangeable.

For this purpose, the elastic forming element 50 comprises means for connecting it to the cushion 2 in a localized zone of the upper face of the cushion.

These connecting means are formed by at least one rivet 51 having two flat thin heads of large area or by at least one nail having a flat head.

The elastic forming element 50 may also be adhered to the upper face of the cushion 2.

When the depth of the drawing of the sheet blank 20 is great, the elastic element 50 permits avoiding subjecting the cushion 2 to large deformations and high pressures and obtaining the marking of details in particular having small radii.

Further, this elastic element 50 may have any shape such as for example that of the blank or of the finished part to be obtained.

The elastic forming element 50 undergoes a very low elongation and a sliding action is indispensable between this element and the skin 6 of the cushion 2.

The elastic forming element 50 may be localized in at least an angular zone of the cushion 2 and may be formed by different pieces having different hardnesses.

This elastic forming element 50 may include on its face in contact with the cushion 2 a lip for rounding the cushion.

In another alternative embodiment illustrated in FIG. 6, the lateral walls 30 may be covered with an antifriction material 14 obtained by spraying a suitable product on said walls or constituted by at least one sheet of plastics material or a sheet of rubber, it being possible to employ this arrangement in all the described embodiments.

Further, an interchangeable working sheet 15 may be interposed between the skin 6 of the upper face of the cushion 2 and the lower blank holder 7 (FIG. 6) or the upper plate 40*b* of the single unit 40, as in the alternative embodiments illustrated in FIGS. 4 and 5.

This working sheet 15 of an elastic material has a Shore hardness substantially equal to the Shore hardness of the skin 6 of the cushion 2 and may be fixed to the lower blank holder 7 or to the upper plate 40*b* of the single unit 40.

In the case where the device comprises an elastic element 50 for forming the sheet blank 20 as shown in FIG. 6, this element 50 is connected to the sheet 15 in a localized zone by suitable means such as a rivet 51 or a nail.

The working sheet 15 may be formed by at least two superimposed and optionally locally interconnected layers.

At least one of the layers of this working sheet may be formed by an elastic textile material and/or include substantially parallel slots.

Moreover, the antifriction material 14 disposed on the walls 1*b* or 30 of the enclosure 1 or the walls of the piece 40, and the working sheet 15 may be substituted for the skin 6 of the cushion 2.

In a further alternative embodiment illustrated in FIG. 7, modulable wall elements 60 are interposed between the lateral walls 1*b* of the enclosure 1 nd the peripheral sleeve 8 to reduce the suction phenomenon.

The modulation of the volume of the enclosure 1 and therefore of the dimensions of the cushion 2 ensures a ratio of the surface area of the cushion to the surface area of the part which is close to 2 and a control of the suction effect for all dimensions of the parts.

The modulable and interchangeable wall elements 60 are composed of a quasi-incompressible material, such as for example machinable planks or boards employed in the construction of models.

The number of wall elements employed affords great freedom in the choice of the dimensions of the enclosure 1 and the cushion 2 for a single given press tool and framework.

The other elements of the device are identical and the part is drawn in the same way.

In all cases, the lower blank holder 7 or the upper plate 40*b* of the single unit 40 may be made from two machined plates defining an air inlet therebetween. One of the plates may be of an incompressible elastic material.

The plate of the lower blank holder 7 or the upper plate 40*b* in contact with the sheet blank 20 may include on its vertical inner face grooves for improving the passage of air toward the upper part of the part to be formed.

This plate of the lower blank holder 7 or plate 40*b* in contact with the sheet blank 20 may be constituted by an assembly of planks or boards.

The lower blank holder may have a shape corresponding to the shape of the peripheral zone of the finished part to be obtained.

The lower blank holder 7 or the upper plate 40*b* of the single unit 40 permits a clamping action with the upper blank holder 11 on at least localized zones of the sheet blank 20.

The support plate 32 may have an inner cavity for containing the cushion 2 or may be made as a single unit with the bolster 33.

Further, means for regulating the pressure created in the cushion 2 when forming the part may be interposed between the support 32 and the bolster 33.

The device according to the invention has the advantage of greatly reducing any phenomenon involving the pinching or lamination of the cushion and improving the effectiveness and the life of this cushion for mass producing drawn parts.

It also has the advantage of allowing an easy regulation of the supporting force exerted by the lower blank holder in the course of the forming operation and obtaining small radii on the drawn part.

What is claimed is:

1. Device for drawing a sheet material or blank, comprising;

an enclosure having lateral walls, a cushion of elastic material having lateral faces and disposed in said enclosure, means for forming said sheet material or blank comprising a die having a peripheral portion constituting an upper blank holder, and a lower blank holder which constitutes means for supporting and maintaining at least a portion of said sheet material or blank placed directly on said cushion and which is cooperative with said upper blank holder for clamping at least localized zones of said sheet material or blank, and a slidable element disposed around said lateral faces of said cushion, said lower blank holder bearing against said slidable element, said slidable element comprising a peripheral sleeve disposed between said lateral walls of said enclosure and said lateral faces of said cushion, said peripheral sleeve and said lower blank holder being interconnected and slidable in said enclosure.

2. Device according to claim 1, wherein modulable wall elements are interposed between said lateral walls of said enclosure and said peripheral sleeve.

3. Device according to claim 1, comprising at least one elastic means cooperative with said peripheral sleeve and said lower blank holder for subjecting said peripheral sleeve and said lower blank holder to a return force.

4. Device according to claim 3, wherein said at least one elastic means comprises a system of springs.

5. Device for drawing a sheet material or blank, comprising;

an enclosure having lateral walls, a cushion of elastic material having lateral faces and disposed in said enclosure, means for forming said sheet material or blank comprisnig a die having a peripheral portion constituting an upper blank holder, and a lower blank holder which constitutes means for supporting and maintaining at least a portion of said sheet material or blank placed directly on said cushion and which is cooperative with said upper blank holder for clamping at least localized zones of said sheet material or blank, a slidable element disposed around said lateral faces of said cushion, said lower blank holder bearing against said slidable element, and means defining at least a gap on the periphery of said lower blank holder for passage of air between said lateral walls of said enclosure and said lower blank holder.

6. Device for drawing a sheet material or blank, comprising:

an enclosure having lateral walls, a cushion of elastic material having lateral faces and disposed in said enclosure, means for forming said sheet material or blank comprising a die having a peripheral portion constituting an upper blank holder, and a lower blank holder which constitutes means for supporting and maintaining at least a portion of said sheet material or blank placed directly on said cushion and which is cooperative with said upper blank holder for clamping at least localized zones of said sheet material or blank, a slidable element disposed around said lateral faces of said cushion, said lower blank holder bearing against said slidable element disposed around said lateral faces of said cushion, said lower blank holder bearing against said slidable element, said slidable element being constituted by said lateral walls of said enclosure, and at least one regulating means being cooperative with said walls of said enclosure and said lower blank holder for regulating the displacement of said walls of said enclosure and said lower blank holder, said lateral walls of said enclosure and said lower blank holder constituting a single unit comprising lateral walls, a lower peripheral ring in bearing relation to said regulating means, and an upper plate constituting said lower blank holder and supporting said sheet material or blank said lateral walls of said single unit covered with an antifriction material.

7. Device according to claim 6, wherein said antifriction material is constituted by at least one sheet of plastics material.

8. Device according to claim 6, wherein said antifriction material is constituted by at least one sheet of rubber.

9. Device according to claim 6, wherein said regulating means comprises a system of springs.

10. Device according to claim 6, wherein said lateral walls of said enclosure and said lower blank holder are interconnected.

11. Device for drawing a sheet material or blank, comprising:

an enclosure having lateral walls, a cushion of elastic material having lateral faces and disposed in said enclosure, means for forming said sheet material or blank comprising a die having a peripheral portion constituting an upper blank holder, and a lower blank holder which constitutes means for supporting and maintaining at least a portion of said sheet material or blank placed directly on said cushion and which is cooperative with said upper blank holder for clamping at least localized zones of said sheet material or blank, and a slidable element disposed around said lateral faces of said cushion, said lower blank holder bearing against said slidable element, said lateral walls of said enclosure being covered with an antifriction material.

12. Device according to claim 11, wherein said antifriction material is constituted by at least one sheet of plastics material.

13. Device according to claim 11, wherein said antifriction material is constituted by at least one sheet of rubber.

14. Device for drawing a sheet material or blank, comprising:

an enclosure having lateral walls, a cushion of elastic material having lateral faces and disposed in said enclosure, means for forming said sheet material or blank comprising a die having a peripheral portion constituting an upper blank holder, and a lower blank holder which constitutes means for supporting and maintaining at least a portion of said sheet material or blank placed directly on said cushion and which is cooperative with said upper blank holder for clamping at least localized zones of said sheet material or blank, and a slidable element disposed around said lateral faces of said cushion, said lower blank holder bearing against said slidable element, said lower blank holder comprising at least one duct for the inlet of said between said sheet material or blank and said cushion.

15. Device according to claim 14, wherein said at least one duct is connected to a supply of air under pressure.

16. Device according to claim 14, wherein said lower blank holder comprises at least two machined and superimposed plates defining therebetween said at least one duct.

17. Device according to claim 16, wherein one of said at least two plates is composed of an incompressible elastic material.

18. Device according to claim 16, wherein one of said at least two plates which is in contact with said sheet material or blank comprises grooves on an inner vertical face thereof.

19. Device according to claim 16, wherein one of said at least two plates which is in contact with said sheet material or blank comprises an assembly of machinable boards.

20. Device for drawing a sheet material or blank, comprising:

an enclosure having lateral walls, a cushion of elastic material having lateral faces and disposed in said enclosure, means for forming said sheet material or blank comprising a die having a peripheral portion constituting an upper blank holder, and a lower blank holder which constitutes means for supporting and maintaining at least a portion of said sheet material or blank placed directly on said cushion and which is cooperative with said upper blank holder for clamping at least localized zones of said sheet material o blank, and a slidable element disposed around said lateral faces of said cushion, said lower blank holder bearing against said slidable element, said cushion comprising on an upper face thereof contained within an opening of said lower blank holder an elastic element for forming said sheet material or blank and having a Shore hardness higher than a Shore hardness of said cushion.

21. Device according to claim 20, wherein said elastic forming element is localized in at least an angular zone of said cushion.

22. Device according to claim 20, wherein said elastic forming element comprises at least two layers having different thicknesses and hardnesses.

23. Device according to claim 20, wherein said elastic forming element comprises different pieces having different hardnesses.

24. Device according to claim 20, wherein said elastic forming element comprises, on a face thereof in contact with said cushion, a lip for rounding said cushion.

25. Device according to claim 20, wherein said elastic forming element is interchangeable.

26. Device according to claim 20, wherein said cushion comprises on an upper face thereof an interchangeable working sheet composed of an elastic material.

27. Device according to claim 26, wherein said working sheet is connected to said lower blank holder.

28. Device according to claim 26, wherein said working sheet comprises at least two superimposed layers.

29. Device according to claim 28, wherein said at least two layers of said working sheet are locally interconnected.

30. Device according to claim 28, wherein at least one of said at least two layers of said working sheet is composed of an elastic textile material.

31. Device according to claim 28, wherein at least one of said at least two layers of said working sheet comprises substantially parallel slots.

32. Device according to claim 26, wherein said elastic forming element comprises means for connecting it to said working sheet in a localized zone of an upper face of said working sheet.

33. Device according to claim 32, wherein said connecting means comprise at least one nail having a flat head.

34. Device according to claim 32, wherein said connecting means comprise at least one rivet having two flat heads.

35. Device according to claim 20, wherein said elastic forming element comprises means for connecting it to said cushion in a localized zone of said upper face of said cushion.

36. Device according to claim 35, wherein said connecting means comprise at least one nail having a flat head.

37. Device according to claim 35, wherein said connecting means comprise at least one rivet having two flat heads.

38. Device for drawing a sheet material or blank, comprising:

an enclosure having lateral walls, a cushion of elastic material having lateral faces and disposed in said enclosure, means for forming said sheet material or blank comprising a die having a peripheral portion constituting an upper blank holder, and a lower blank holder which constitutes means for supporting and maintaining at least a portion of said sheet material or blank placed directly on said cushion and which is cooperative with said upper blank holder for clamping at least localized zones of said sheet material or blank, and a slidable element disposed around said lateral faces of said cushion, said lower blank holder bearing against said slidable element, said cushion comprising on a lower face thereof in contact with a bottom of said retaining enclosure an incompressible elastic sole having a Shore hardness higher than a Shore hardness of said cushion.

39. Device according to claim 38, wherein said elastic sole is in the shape of a ring.

* * * * *